United States Patent [19]

Conn

[11] 4,108,340

[45] Aug. 22, 1978

[54] WRIST BAND CASE FOR HOUSING A WATCH AND/OR A MINI COMPUTER OR CALCULATOR

[76] Inventor: John L. Conn, P.O. Box 4501 Station B., Spartanburg, S.C. 29303

[21] Appl. No.: 586,084

[22] Filed: Jun. 11, 1975

[51] Int. Cl.[2] ..... A44C 5/00

[52] U.S. Cl. ..... 224/4 E; 24/163 R; 58/88 E; 58/152 R; 224/28 R; 224/28 W

[58] Field of Search ..... 224/28 R, 4 A, 4 F, 224/4 D, 4 E, 4 G, 4 B, 4 H, 4 C, 4 J, 4 K, 28 A, 28 B, 28 C, 28 D, 28 W, 5 R, 26 R, 26 E; 58/152 R, 152 C, 152 A, 88 WC, 88 SC; 235/91, 92, 156; 24/265 WS, 163 BR

[56] References Cited

U.S. PATENT DOCUMENTS

| | | | |
|---|---|---|---|
| 1,160,616 | 11/1915 | Jeffery | 224/4 H |
| 1,453,671 | 5/1923 | Harrold | 224/28 B X |
| 2,955,357 | 10/1960 | Uebelhardt | 58/152 C UX |
| 3,855,637 | 12/1974 | Luger | 24/163 BR X |

FOREIGN PATENT DOCUMENTS

| | | | |
|---|---|---|---|
| 74,253 | 3/1916 | Switzerland | 224/4 H |

*Primary Examiner*—Trygve M. Blix
*Assistant Examiner*—Jerold M. Forsberg

[57] ABSTRACT

An improved construction in the assembly of a containing case or housing compartments for the common watch and or the mini computer or calculator wherein the case or compartment or container is fastened to the wrist as the common watch wherein the case will revolve so as to contain or house a watch on the one side and also house a mini computer or calculator on the other side, thus the two in one assembly.

This invention does not involve the mechanism of the watch, computer or calculator, just the wrist band and housing case.

3 Claims, 4 Drawing Figures

WRIST BAND CASE FOR HOUSING A WATCH AND/OR A MINI COMPUTER OR CALCULATOR

This invention relates generally to the common wrist watch wherein the reversable dual housing or case can be used to contain a watch and also a mini computer or calculator.

A principle object of the present invention is to provide a dual housing container case for a watch and or a mini computer or calculator.

Another principle object of the present invention is to provide a computer or calculator housing case that can be worn with the common watch so as to have the computer or calculator always available for use.

Another object of the present invention is to provide a watch and computer or calculator carrying or housing case wherein the wrist band will turn 360° so as to turn the complete case to either use the watch or mini computer without removing said wrist band.

Another object of the present invention is to provide a dual housing case wherein a dial pick is contained in the case so as to operate the mini computer or calculator dial operations buttons wherein the dial pick is stored in a storage compartment therein.

These and other objects will be readily evident upon a study of the following specifications and the accompaying drawings wherein.

Figure 1:
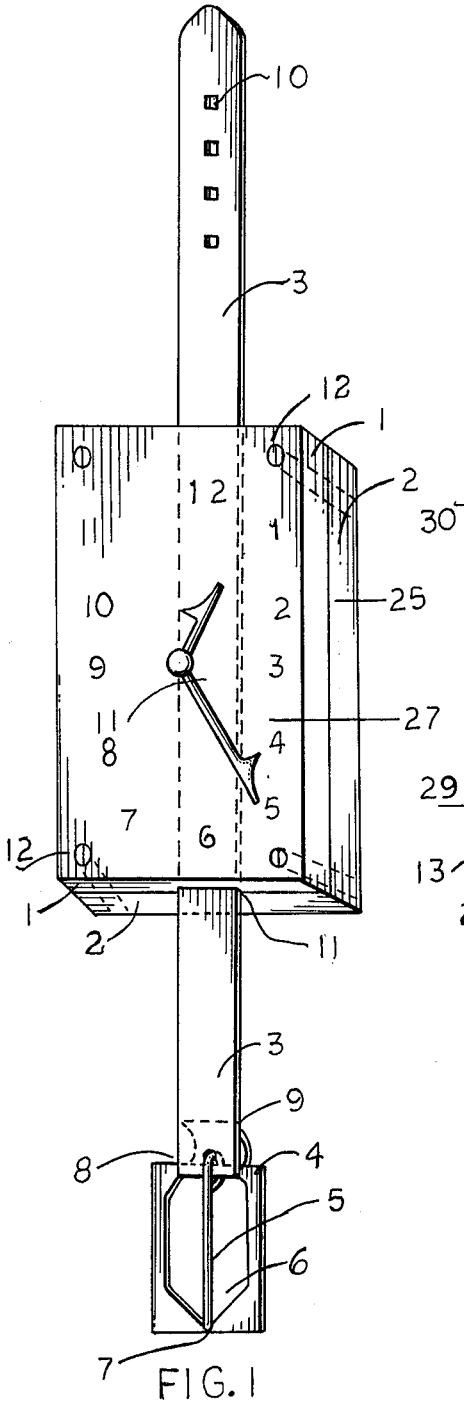
FIG. 1 is a view of the wrist band and container or carrying case for the common watch and mini computer or calculator case wherein the watch case is seen.
Figure 2:
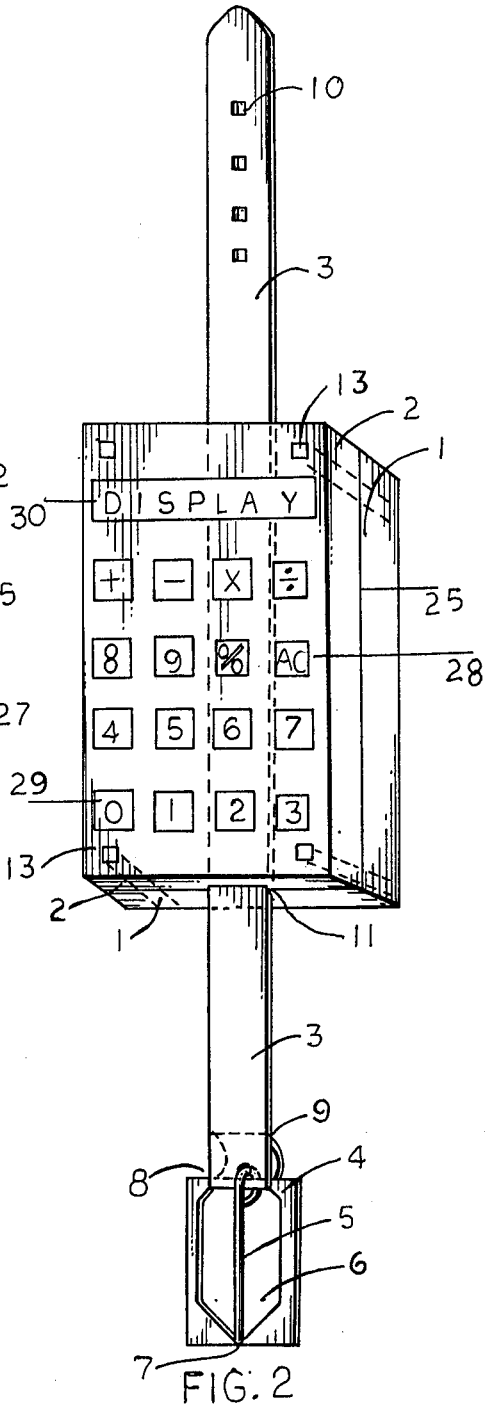
FIG. 2 is a view of the wrist band and container or carrying case for the common watch and mini computer or calculator case wherein the computer or calculator case is seen.

Refering now to the drawings in more detail wherein the reference numeral 1 represents the watch case 1 and the computer or calculator case 2 wherein these two seperate carrying or housing cases 1 and 2 are secured together by bolt or screw 12 and nut 13 to contain these two cases 1 & 2 as one unit wherein the wrist band 3 is thus also secured between 11 these two cases 1 & 2.

The wrist strap or band 3 is constructed as the common watch band assembly wherein the band contains the buckle 4, 5, 6, 7, & 8 that are fastened 9 to the band 3 AND connected to the band 3 at the hole areas 10 to fasten said band 3.

Figure 3:
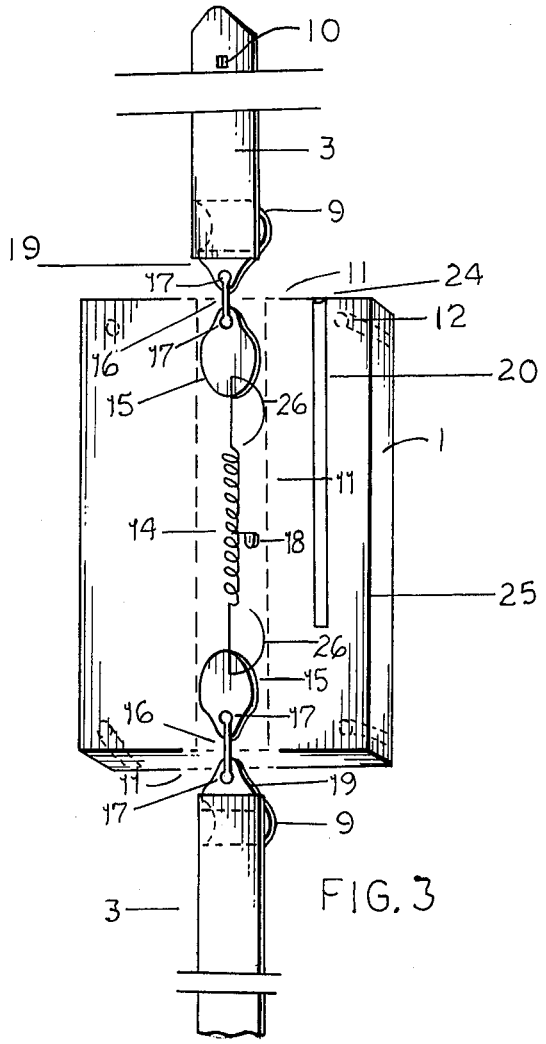
FIG. 3 is a view of the wrist band case in a modified design of the swivel bands and also the storage compartment for the dial pick.
Figure 4:
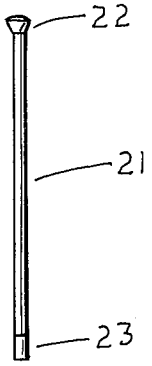
FIG. 4 is a view of the dial pick that is used as per the fingers to operate said small calculator mini dials.

FIG. 3 is thus a modified version and view wherein the watch or calculator case 1 & 2 can be lifted while on the wrist and thus turned or revolved to either use the watch 1 or the calculator 2 where the two cases 1 & 2 are joined together by the bolt or screw 12 & 13 so as to contain this modified swivel design FIG. 3 between 11 the two cases 1 & 2 wherein the bands are connected or fastened 9 to the metal swivel clamp housings 19 wherein the shafts 16 will turn in the metal swivel clamp housing 15 & 19 secured at the ends by by the holding ball ends 17 wherein these center holding swivel clamps 15 will both connect to the spring ends 26 and the spring 14 so as to be pulled up and out from the wrist so as to be lifted and turned, said spring 14 being attached to the inter case slot area 11, spring attached at screw 18. This mini calculator case 2 is small in size and thus the dials on the calculator case 29 at the surface area 28 will be operated by the mini dial pick 21 that has the rubber ends 22 & 23 wherein the rubber end 22 is thus squeezed when stored in the storage compartment 20 to fasted at the opening area of the compartment 24, since this end is larger than the hole 24. Both of the cases join together at the back areas of each case 25 wherein the watch face case 27 and the calculator face 28 are opposite. The display area of the computer or calculator case is thus shown as number 30.

While various changes may be made in the detail construction, it is understood that such changes will be within the spirit and scope of the present invention as defined by the claims.

What is claimed is:

1. The combination of a wrist watch and computer composite housing with a wrist band therefore, wherein said housing comprises a pair of similar shaped cases mounted together along abutting rear surfaces, one of said cases having a watch with a visible front face and the other of said cases having a computer with a visible front face wherein said front faces are disposed on opposite sides of the composite housing, a longitudinal slot through the center line of the housing formed by said abutting rear surfaces, a wrist band having a central portion mounted in said slot with the ends of the band extending from opposite ends of the slot, said central portion including an elastic section and connecting means swivelly securing the extending end portions of the band to the central portion, wherein said end connecting means are extendible outward of said slot and the central portion of said band is longitudinally slidable in said slot whereby the elastic section permits the composite case to be pulled away from the wrist and the swivel means permits the case to be rotated for exposure of either of the opposite sides.

2. The combination of claim 1 wherein the end connecting means comprise a swivel holder with a shaft rotatably secured to the swivel holder at one end and to said outer portion of the band by means of ball joints, and wherein said elastic section is a coiled spring secured to said swivel holder.

3. The combination of claim 2 including a computer dial pick mounted removably in said housing.

* * * * *